United States Patent [19]

Aslan

[11] Patent Number: 4,789,869

[45] Date of Patent: Dec. 6, 1988

[54] DIPOLE ANTENNA FOR MONITORING ELECTROMAGNETIC WAVES OVER AN EXTENDED FREQUENCY RANGE

[75] Inventor: Edward E. Aslan, Plainview, N.Y.

[73] Assignee: The Narda Microwave Corporation, Hauppauge, N.Y.

[21] Appl. No.: 59,130

[22] Filed: Jun. 8, 1987

[51] Int. Cl.[4] ..... H01Q 9/16

[52] U.S. Cl. ..... 343/801; 343/793; 343/792

[58] Field of Search ..... 343/801, 792, 793, 810

[56] References Cited

U.S. PATENT DOCUMENTS

| | | | |
|---|---|---|---|
| 3,339,205 | 8/1967 | Smitka | 343/801 |
| 4,604,628 | 8/1986 | Cox | 343/792 |
| 4,634,968 | 1/1987 | Aslan | 324/95 |

FOREIGN PATENT DOCUMENTS

| | | | |
|---|---|---|---|
| 0148407 | 8/1984 | Japan | 343/793 |

*Primary Examiner*—William L. Sikes
*Assistant Examiner*—Hoanganh Le
*Attorney, Agent, or Firm*—Hoffmann & Baron

[57] ABSTRACT

The present invention relates to a dipole antenna for monitoring electromagnetic radiation fields over an extended frequency range with essentially flat characteristics. The dipole antenna includes two arms, each of which is divided into two or more conducting elements. In one arm, a relatively low resistance is connected in series between the segments, and in the other arm, a relatively large resistance is connected in series between the segments.

10 Claims, 3 Drawing Sheets

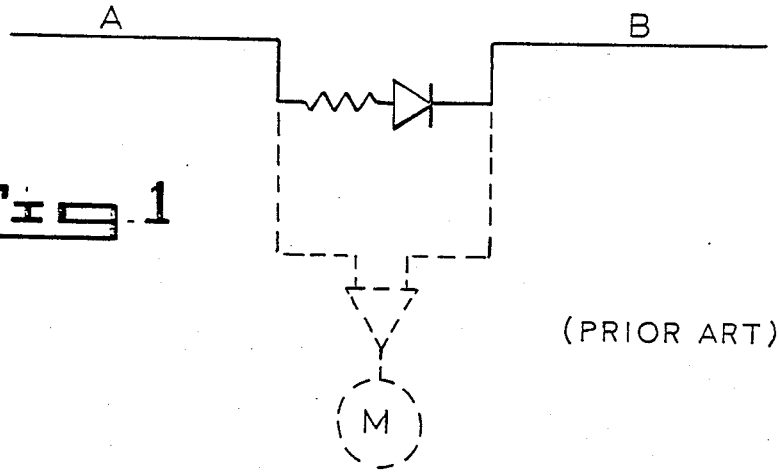
Fig. 1
(PRIOR ART)
Fig. 2
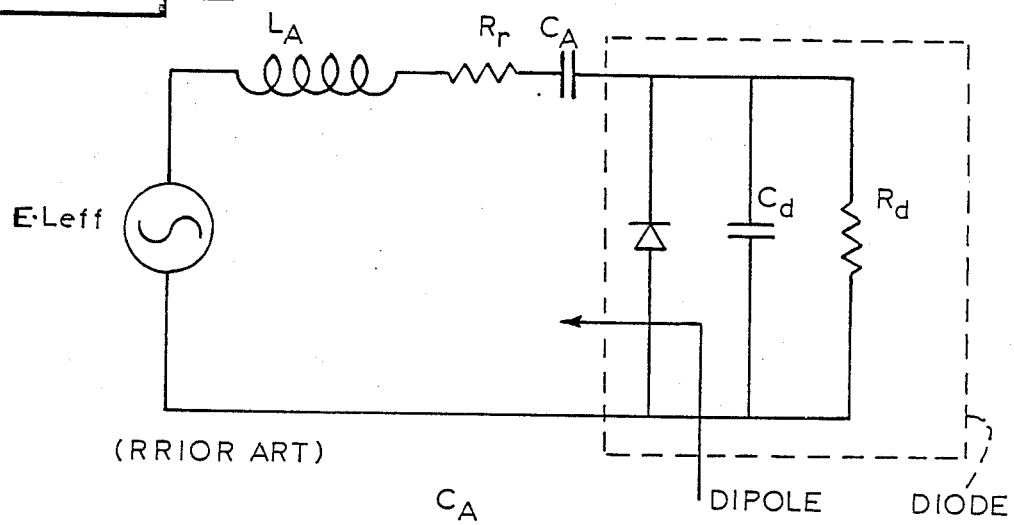
(RRIOR ART)
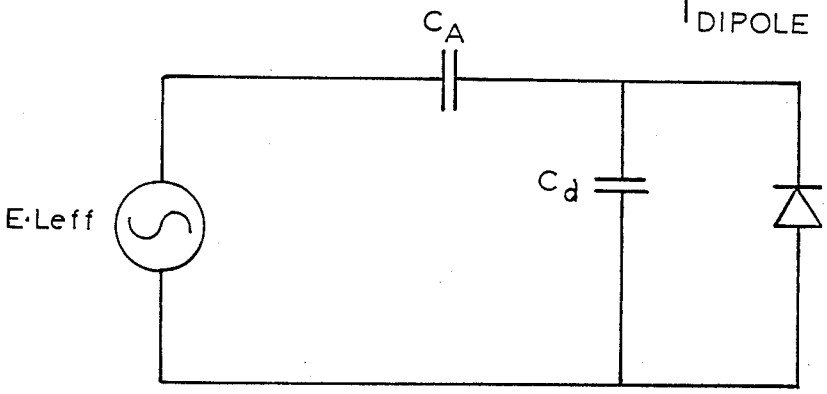
(PRIOR ART)
Fig. 3

DIPOLE ANTENNA FOR MONITORING ELECTROMAGNETIC WAVES OVER AN EXTENDED FREQUENCY RANGE

BACKGROUND OF THE INVENTION

1. Field of the Invention

This invention relates to monitoring electro-magnetic radiation fields, and more particularly to dipole antennas for radiation monitors which have an extended frequency response both above and below the nominal flat frequency response for conventional dipole antennas.

2. Description of the Prior Art

The response of dipole antennas over a range of frequencies in electromagnetic radiation fields is typically achieved by the use of calibration factors to quantify the signal. On either side of the resonant frequency of the dipole antenna, a decrease in signal strength is experienced with both increasing and decreasing frequency in an otherwise uniform field. The very low impedance of antennas near the natural dipole resonant frequency is itself a factor which reduces the useful range of the antenna for broadband operation. While the use of calibration factors in the instrument can be effective in broadening the response over a widened frequency range, it requires a knowledge of the exact frequency of the signal. Also, when more than one signal is involved at the same time, it is difficult to determine the total energy in the field.

Accordingly, it is a primary object of the present invention to provide a dipole antenna structure for monitoring electromagnetic radiation fields over an extended frequency range characterized by an essentially flat frequency response without requiring the use of calibration factors to quantify the received signals and the need for knowing the exact frequency thereof.

It is a further object of the present invention to provide a dipole antenna structure for monitoring electromagnetic fields over an extended frequency range, characterized by an essentially flat response (i.e. constant sensitivity) thereover, which permit the determination of the total energy of an electromagnetic radiation field when more than one signal is involved.

SUMMARY OF THE INVENTION

The present invention utilizes a technique whereby the flat frequency response of a dipole antenna structure is extended by segmentation and resistive coupling of the conductive elements thereof.

In accordance with the present invention, the two arms of the dipole antenna are modified differently. Both arms are divided into two or more segments, preferably of corresponding lengths in both arms, and the segments are coupled in one arm with a relatively low resistance and in the other with a relatively high resistance.

The high resistance coupling at low frequencies has a resistance value which is low relative to the impedance of the outer segment of the arm so that the signal delivered to the load connected between the two arms is greater than at high frequencies when the resistance becomes high relative to the impedance of the outer segment. A lesser signal is delivered to the load and one segment of the arm is essentially de-coupled so that the effective length of the arm appears shorter than at the lower frequency, thus compensating for low frequency roll off.

At higher frequencies, approaching resonance, the sensitivity of the antenna increases. The low resistance resistor in the other arm has a value which is high relative to the outer segment of that arm, thus essentially decoupling the outer segment and decreasing the effective length of the dipole. This reduces sensitivity at the most sensitive frequency range and contributes to the flattening of the response over a broader frequency range.

Other and further objects will be explained hereinafter, and will be more particularly delineated in the appended claims, and other objects of the present invention will in part be obvious to one with ordinary skill in the art to which the present invention pertains, and will, in part, appear obvious hereinafter.

DESCRIPTION OF THE DRAWINGS

For a fuller understanding of the objects of the present invention, reference is made to the following detailed description of the preferred embodiment which is to be taken in connection with the accompanying drawings, wherein:

FIG. 1 is a schematic diagram of a conventional dipole antenna;

FIG. 2 is an equivalent circuit diagram for a conventional dipole antenna terminated with a diode detector;

FIG. 3 is a lumped equivalent circuit for a conventional dipole antenna, for the mid-range of frequency operation thereof;

DETAILED DESCRIPTION OF THE PREFERRED EMBODIMENT

It is now in order to describe in a best mode embodiment, the details of the dipole antenna of the present invention. However, before doing so, it is appropriate at this juncture to briefly discuss prior art dipole antenna structures, by referring to FIGS. 1, 2, 3, 4 and 5 and point out the inherent limitations thereof with respect to frequency response characteristics.

FIG. 1 shows a schematic diagram of a conventional dipole having a first and second arm with a typical diode termination circuit connected thereto. In FIG. 2, a lumped equivalent circuit diagram for the dipole antenna terminated with a typical diode detector, is shown. In this circuit diagram, the electric field induced voltage is represented by a voltage source E Leff, the dipole antenna inductance by $L_a$, the dipole radiation resistance by $R_r$, and the dipole antenna capacitance by $C_a$. Connected to the circuit model of the dipole antenna, is the diode detector which is represented by a circuit comprising a diode, capacitor, and a resistor in parallel combination. The diode resistance is designated by $R_d$ and diode capacitance by $C_d$.

Over the mid-range of frequencies 10 to 800 MHz, the antenna inductance, radiation resistance, and diode resistance have negligible effect upon the frequency response of the dipole antenna. Accordingly, the lumped equivalent circuit of FIG. 2 behaves like a capacitive divider which is independent of frequency, and thus can be represented by the lumped equivalent circuit shown in FIG. 3, with the diode resistance, dipole radiation resistance, and dipole inductance eliminated therefrom.

Figure 4:
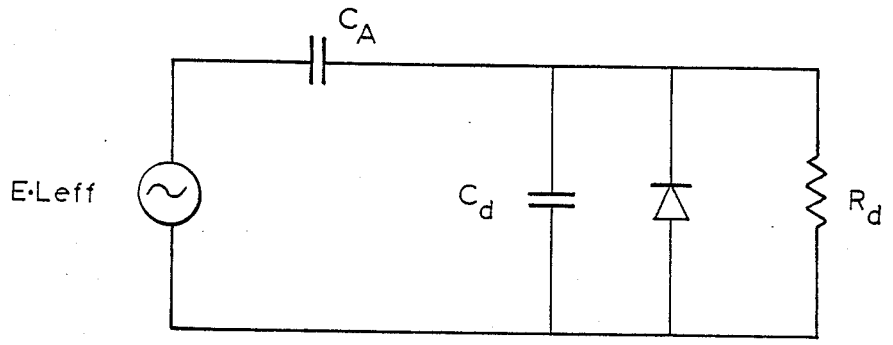
Fig. 4 (PRIOR ART)
FIG. 4 is a lumped equivalent circuit for a conventional dipole antenna for the frequency range below resonance.

As the frequency of the electromagnetic field decreases within the range of 0.3 to 10 MHz, the diode resistance $R_d$ contributes significantly to the impedance of the equivalent circuit, and the response of the dipole antenna becomes dependent upon frequency, and can be modelled by the lumped equivalent circuit of FIG. 4. Over this frequency band, the voltage across the diode decreases in a constant electromagnetic radiation field, as the frequency thereof decreases, thereby reducing the useful range of the dipole antenna for field strength monitoring purposes. Accordingly, the sensitivity of the dipole circuit decreases over this frequency band as the frequency of the radiation field decreases.

Figure 5:
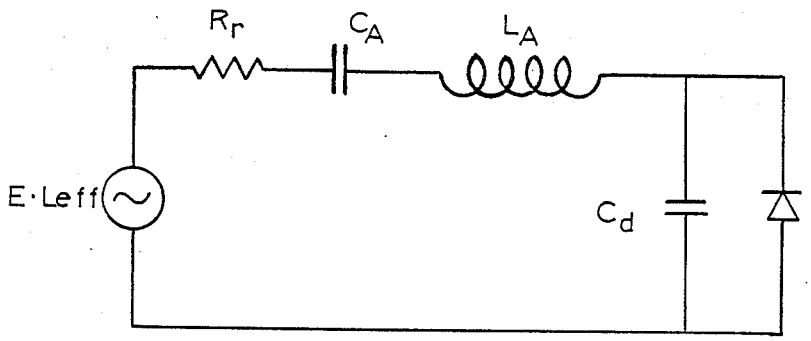
Fig. 5 (PRIOR ART)
FIG. 5 is a lumped equivalent circuit for a conventional dipole antenna for the frequency band near and at resonance.

As the frequency of the electromagnetic radiation field increases, approaching resonance, the dipole antenna can be modelled by the lumped equivalent circuit shown in FIG. 5. Therein, diode resistance $R_d$ is eliminated, as the reactances of the dipole and diode dominate. As the resonant frequency of the dipole antenna is approached, the total antenna reactance comprising $C_a$ and $L_a$ decreases as to increase the voltage across the diode, thereby increasing the sensitivity of the dipole antenna. This phenomenon also reduces the useful range of the dipole antenna for broad band operation.

In summary, the impedance of the dipole varies from a low value at its resonance frequency, to a higher value moving away therefrom. Therefore, the radio frequency (RF) voltage delivered to the dipole terminals varies as a function of the frequency of the illuminating field. Well below the resonant frequency, the sensitivity is low due to the increased reactance of the antenna relative to the impedance of the diode termination. As the frequency approaches resonance, the sensitivity of the dipole increases, caused by decrease in antenna reactance relative to the decrease in the diode termination impedance. Accordingly, the useful frequency response of a dipole antenna has been inherently limited for the reasons given above.

Figure 6:
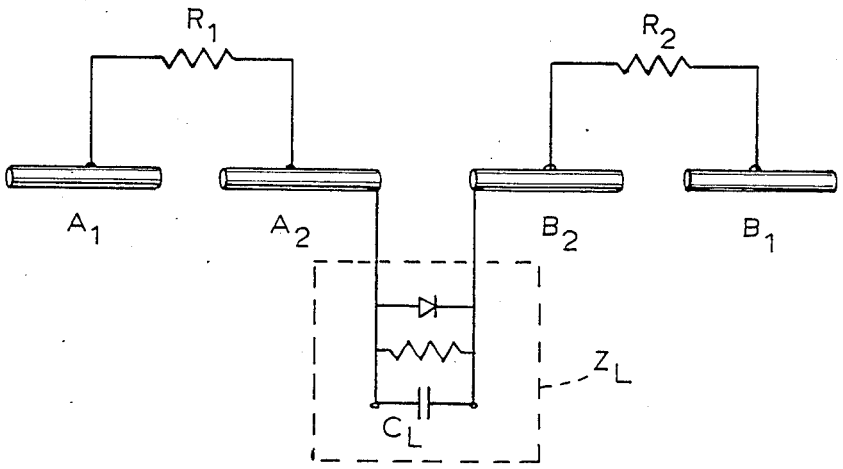
FIG. 6 is a schematic diagram of the dipole antenna structure of the present invention showing a relatively low resistance connection between the segments of one arm thereof, and a relatively high resistance connected between the segments of the other arm thereof.

Referring now to FIG. 6, the dipole antenna structure of the present invention is shown having a means for extending the useful "flat" frequency response thereof. According to the principle of the present invention, the useful flat response of the dipole can be extended at both high and low frequencies (i.e. above and below resonance), by segmenting the dipole antenna and providing resistance coupling to the segments $A_1$ and $A_2$ and $B_1$ and $B_2$.

As illustrated in FIG. 6, two segments $A_1$ and $A_2$ of one arm of the dipole are connected by a high resistance, $R_1$ e.g. 10K Ohms, and two segments $B_1$ and $B_2$ of the other arm thereof are connected by a low resistance, $R_2$ e.g. 100 Ohms.

At some low frequency, e.g., $f_L = 10$ MHz, the 10K Ohm resistance is equal to or less than the impedance of the segment $A_1$, and the signal strength delivered to the load $Z_L$, is greater than where, at a frequency greater than $f_L$, this resistance is high relative to the impedance of the segment $A_1$ and a lesser signal is delivered to the termination diode, $Z_L$. At this frequency, the segment $A_1$ is essentially decoupled, and the effective length of the arm comprising $A_1$, $A_2$ and $R_1 = 10$K Ohms appears shorter than at below frequency $f_L$. This segmenting and resistance coupling in the one arm of the dipole antenna structure hereof, compensates for the low frequency roll off typical with prior art dipole antenna designs.

At higher frequencies approaching resonance, $f_r$, the sensitivity of a conventional dipole antenna would tend to increase. In the dipole antenna structure of the present invention, the impedance of the two segments $B_1$ and $B_2$ of the other arm decreases as the frequency of the illuminating field increases. Relative to the impedance of segment $B_1$, the impedance of the 100 Ohm resistance $R_2$ is high, the effect of which essentially decouples the segment $B_1$ from the arm, and thereby decreases the effective length of the dipole, reducing its sensitivity.

The effect of the segmenting and resistive coupling, is to produce a flatter response over a larger frequency range.

Figure 7:
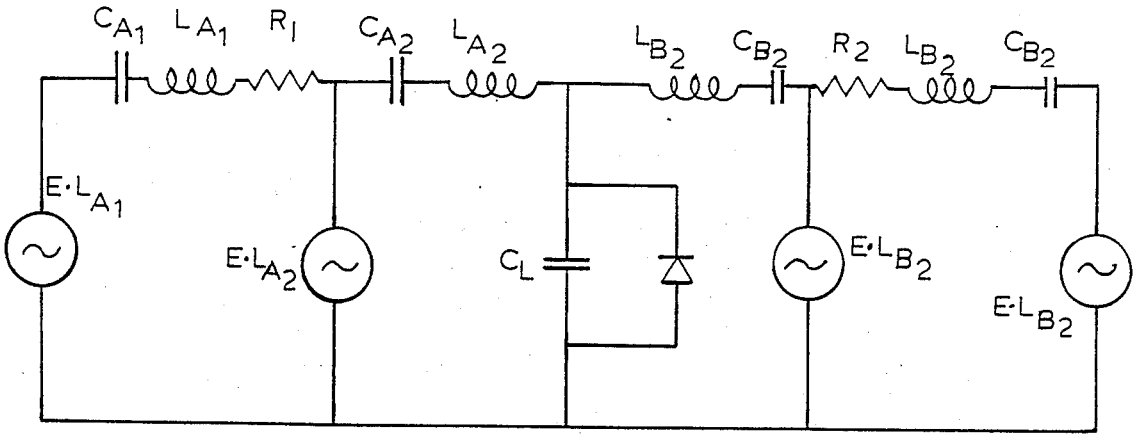
FIG. 7 is a lumped equivalent circuit of the dipole antenna structure of the present invention which has segmented sections and coupling resistors as showing in FIG. 6.

Referring now to FIG. 7, there is shown lumped equivalent circuit of the dipole antenna of the present invention, having segmented sections and coupling resistances. In order to determine what the lengths of the respective segments must be in each of the arms of the dipole antenna structure hereof, as to provide an antenna tuned to an extended frequency band, both capacitances $C_1$ and $C_2$, and inductances $L_2$ and $L_2$ can be calculated for the lumped equivalent circuit of FIG. 7. Conversely, the capacitances and inductances of the lumped equivalent circuit, can be computed from lengths of the segments In FIG. 7, $E \cdot L_{A1}$, $E \cdot L_{A2}$, $E \cdot L_{B2}$ and $E \cdot L_{B1}$ represent the induced voltages along the segments $A_1$, $A_2$, $B_2$ and $B_1$, respectively.

Figure 8:
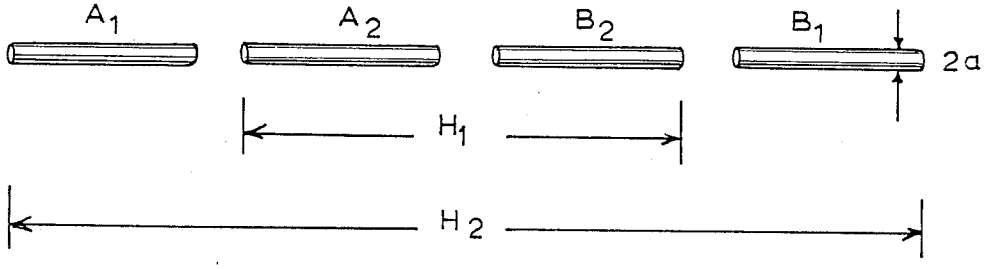
FIG. 8 is a schematic diagram of the dipole antenna structure of the present invention, having symmetrical segments as shown therein.

The values for such capacitances can be derived from the average characteristic impedance of the segments $A_1$, $A_2$, $B_1$ and $B_2$ of the dipole antenna structure hereof. For a dipole with symmetrical segments as shown in FIG. 8, where the length of $A_1 = B_1$ and the length of segment $A_2 = B_2$, then $C_{A1} = C_{B1}$ and $C_{A2} = C_{B2}$. For $H_1$ and $H_2$ in centimeters:

$$C_{A2} = C_{B2} = 0.22 \times 10^{-12} \left[ \frac{H_1}{\mathrm{Ln}\left(\frac{H_1}{a}\right) - 1} \right]$$

$$C_{A1} = C_{B1} =$$

$$0.22 \times 10^{-12} \left[ \frac{H_2}{\mathrm{Ln}\left(\frac{H_2}{a}\right) - 1} - \frac{H_1}{\mathrm{Ln}\left(\frac{H_1}{a}\right) - 1} \right]$$

The inductances derived from the average characteristic impedance are:

$$L_{A1} = L_{B1} =$$

-continued $$\left[H_2\left(\mathrm{Ln}\frac{H_2}{a}\right)-H_1\left(\mathrm{Ln}\frac{H_1}{a}\right)+(H_1-H_2)\right]\times 10^{-9}$$

and $$L_{A2}=L_{B2}=\left[H_1\left(\mathrm{Ln}\frac{H_1}{a}\right)-H_1\right]\times 10^{-9}$$

The invention may be modified by using only the high resistance or low resistances to increase the bandwidth at either the low or high frequency ends, respectively. This can be accomplished symmetrically by using two of the same (high or low) resistances in each of the segmented arms.

Further modifications of the present invention herein disclosed will occur to persons skilled in the art to which the present invention pertains and all such modifications are deemed to be within the scope and spirit of the present invention defined by the appended claims.

What is claimed is:

1. A dipole antenna for monitoring electromagnetic radiation fields over an extended frequency range below the resonant frequency of the dipole antenna and having essentially flat response characteristics, comprising:

dipole in which each of the two arms is divided into two or more conducting segments:

a relatively low resistance connecting the segments in series in one arm; and a relatively high resistance connecting the segments in series in the other arm.

2. A dipole antenna as set forth in claim 1 in which corresponding segments in each arm are the same length.

3. A dipole antenna as set forth in claim 1 in which each arm is divided into two segments and the relatively low resistance in one arm is less than 100 ohms and the relatively high resistance in the other arm is greater than 10K ohms.

4. A dipole antenna as set forth in claim 3 in which corresponding segments in each arm are of substantially equivalent length.

5. A dipole antenna for monitoring electromagnetic radiation fields over an extended frequency range below resonant frequency of the dipole antenna and having essentially flat response characteristics, comprising:

a dipole in which each of the two arms is divided into two or more conducting segments of substantially equal length, one of the conducting segments in each of the arms being an outer segment;

a relatively low resistance connecting the segments in series in both arms, the relatively low resistance being approximately equal to the reactance of the outer segment in the first and second arms at frequencies approaching the resonance region of the dipole antenna frequency response characteristic.

6. A dipole antenna for monitoring electromagnetic radiation fields over an extended range below the resonant frequency of the dipole antenna and having essentially flat response characteristics, comprising:

a dipole in which each of the two arms is divided into two or more conducting segments, one of the conducting segments in each arm being an outer segment; and a relatively high resistance connecting the segments in series in both arms, the relatively high resistance being approximately equal to the reactance of the outer segment in the first and second arms at frequencies approaching the low frequency roll-off region of the dipole antenna frequency response characteristic.

7. A dipole antenna for monitoring electromagnetic radiation fields over an extended frequency range and having a frequency response characteristic characterized by a low frequency roll-off region, an essentially flat region, and a resonance region, said dipole antenna comprising:

a dipole having first and second arms, each of which is divided into two or more conducting segments, one of the conducting segments in each of the arms being an outer segment;

a relatively low resistance connecting the segments in series in the first arm, said relatively low resistance being approximately equal to the reactance of the outer segment in the first arm at frequencies approaching the resonance region of the dipole antenna frequency response characteristic; and a relatively high resistance connecting the segments in series in the second arm, said relatively high resistance being approximately equal to the reactance of the outer segment in the second arm at frequencies approaching the low frequency roll-off region of the dipole antenna frequency response characteristic.

8. A dipole antenna as set forth in claim 7 in which corresponding segments in each arm are the same length.

9. A dipole antenna as set forth in claim 7 in which each arm is divided into two segments and the relatively low resistance in the first arm is less than 100 ohms and the relatively high resistance in the second arm is greater than 10K ohms.

10. A dipole antenna as set forth in claim 9 in which corresponding segments in each arm are of substantially equivalent length.

* * * * *